US007806402B2

(12) United States Patent
Sato et al.

(10) Patent No.: US 7,806,402 B2
(45) Date of Patent: Oct. 5, 2010

(54) BILL DISCRIMINATING AND COUNTING APPARATUS

(75) Inventors: Tomoyasu Sato, Himeji (JP); Atsushi Suzuki, Himeji (JP); Toshihiko Suzuki, Himeji (JP)

(73) Assignee: Glory, Ltd., Hyogo (JP)

( * ) Notice: Subject to any disclaimer, the term of this patent is extended or adjusted under 35 U.S.C. 154(b) by 332 days.

(21) Appl. No.: 11/664,995

(22) PCT Filed: Oct. 12, 2004

(86) PCT No.: PCT/JP2004/015340

§ 371 (c)(1),
(2), (4) Date: Apr. 10, 2007

(87) PCT Pub. No.: WO2006/040833

PCT Pub. Date: Apr. 20, 2006

(65) Prior Publication Data

US 2009/0008862 A1 Jan. 8, 2009

(51) Int. Cl.
*B65H 1/06* (2006.01)

(52) U.S. Cl. ..... 271/165; 271/10.11; 271/125

(58) Field of Classification Search ..... 271/10.11, 271/165, 109, 4.1, 122, 121, 125
See application file for complete search history.

(56) References Cited

U.S. PATENT DOCUMENTS

| | | | | |
|---|---|---|---|---|
| 2,950,675 A | | 8/1960 | Copping et al. | |
| 3,933,350 A | * | 1/1976 | Mignano | 271/10.09 |
| 3,957,366 A | | 5/1976 | Taylor et al. | |
| 4,114,870 A | * | 9/1978 | Di Blasio | 271/35 |
| 4,426,073 A | | 1/1984 | Mizuna | |

(Continued)

FOREIGN PATENT DOCUMENTS

| | | |
|---|---|---|
| GB | 1525578 A | 9/1978 |

(Continued)

OTHER PUBLICATIONS

Supplementary European Search Report for European Appln. No. EP 04 77 3790, issued Jan. 15, 2008.

*Primary Examiner*—Kaitlin S Joerger
(74) *Attorney, Agent, or Firm*—Sughrue Mion, PLLC

(57) ABSTRACT

A bill discriminating and counting apparatus in which a plurality of bills with different sizes are filled between side hopper members and fed into a transport path by a feeding mechanism. The feeding mechanism comprises a plurality of rollers disposed in a bilaterally symmetrical state. The plurality of rollers are arranged so that, when a distance between the side hopper members is adjusted according to the longitudinal dimension of a bill with the maximum dimension in the longitudinal direction and a bill with the minimum dimension in the longitudinal direction is disposed at a position where the bill is brought into contact with one of the side hopper members, at least a part of the rollers installed on the opposite side of the side hopper member where the bill is brought into contact therewith is brought into contact with the bill. Also, the feeding mechanism comprises a guide member guiding the bill to the inlet of the transport path. The guide member comprises a guide surfaces formed so that the opening area thereof is gradually increased toward the both ends thereof, and the guide surfaces are formed so that the opening area thereof is converged to zero from the insert port toward the inlet of the transport path.

1 Claim, 11 Drawing Sheets

U.S. PATENT DOCUMENTS

| | | | | |
|---|---|---|---|---|
| 4,607,832 | A * | 8/1986 | Abe | 271/10.08 |
| 4,715,593 | A * | 12/1987 | Godlewski | 271/10.11 |
| 4,858,905 | A * | 8/1989 | Weigel | 271/10.11 |
| 5,207,788 | A * | 5/1993 | Geib et al. | 271/122 |
| 6,186,490 | B1 * | 2/2001 | Sugiura et al. | 271/10.09 |
| 6,375,180 | B1 | 4/2002 | Kawano et al. | |
| 2002/0093134 | A1 | 7/2002 | Minakawa | |

FOREIGN PATENT DOCUMENTS

| | | | |
|---|---|---|---|
| JP | 2003-276931 | A | 10/2003 |
| JP | 2003-296801 | A | 10/2003 |

* cited by examiner

BILL DISCRIMINATING AND COUNTING APPARATUS

TECHNICAL FIELD

The present invention relates to a bill discriminating and counting apparatus for calculating the total amount of bills accepted therein or the number of bills accepted therein for each denomination, and in particular to a bill discriminating and counting apparatus which is able to feed bills having different dimensions without any oblique movement, and is also able to smoothly feed bills having a curled (warped) or folded portion.

BACKGROUND ART

Conventionally a bill discriminating and counting apparatus has been known, which includes a hopper for accepting bills of mixed denominations, and the accepted bills are fed and transported one by one to discriminate the denomination and authenticity of each bill and to count the number of the bills, so that the total amount of the genuine bills or the number of the genuine bills for each denomination is calculated and displayed (see Japanese Patent Application Laid-Open No. 2003-296801, for example).

With reference to FIG. 1, the general structure and operation of the above apparatus will be explained. FIG. 1 is a cross-sectional view showing an internal structure of a general bill discriminating and counting apparatus.

In FIG. 1, bills which are put on a hopper section are fed into a transport path of the bill discriminating and counting apparatus by a feeding roller 5, and are transported by a plurality of transport rollers 6. During the transportation, the bills pass detecting sensors 7*a* and 7*b*, thereby a bill discriminating sensor 8 discriminates the denomination and authenticity of each of the bills. Then the bills pass another detecting sensor 7*c*, and are received between blades of a rotating impeller 9 to be sorted and accumulated in a stacking section 2 when the bill discriminating sensor 8 judges that the bill is genuine. While, when the bill discriminating sensor 8 judges that the bill is a counterfeit bill, a solenoid 10 is operated to cause a branching pawl 11 to move downward to send the bill to a rejecting section 3. The reference numeral 4 designates an operation displaying section where various settings are made for bill discriminating and counting processes.

However, in the above described bill discriminating and counting apparatus, as shown in FIG. 2, when bills having a large difference in longitudinal dimensions among denominations (for example, Euro bills) are put on a mounting platform 1*a* of the hopper section 1, a bill (500 Euro) P1 having a larger longitudinal dimension is fed into the apparatus without an oblique movement, but a bill (5 Euro) P2 having a smaller longitudinal dimension may be fed in an oblique direction. The oblique feeding of the bill P2 occurs, as shown in FIG. 2, because the bill P2 is disposed into the transport path at a position closer to one of symmetrically arranged side hopper members 12*a* and 12*b* (closer to the right side hopper member 12*a* in FIG. 2), and the two feeding rollers 5*a* and two feeding rollers 5*b* which are symmetrically arranged at around the center of the mounting platform 1*a* are not sufficiently in contact with the bill P2, that is, the left side feeding rollers 5*b* are not in contact with the bill P2. The bill P2 which is obliquely fed into the transport path in this way has been a cause of a low transmission.

Moreover, some of the bills put on the hopper section 1 have a deformed portion such as curl (warp) or wrinkle (folding) which is caused by a metal wheel formed on the bills.

Such bills having a deformed portion jam at an insert port of the apparatus, which has been also a cause of a low transmission.

Thus, an apparatus in which bills having such deformation are aligned and accumulated is disclosed in Japanese Patent Application Laid-Open No. 2003-276931, for example. The apparatus includes a stage on which bills are accumulated, side hoppers on sides of the stage, and supportive side hoppers which are pivotably mounted to the side hoppers. The lower parts of the supportive side hoppers and the lower parts of the side hoppers form a space having a shape which is similar to a locus of a curled bill along which the curled bill is stretched. This prevents a curled bill from being fed into the side hoppers when the curled bill is stretched.

However, the above described apparatus disclosed in Japanese Patent Application Laid-Open No. 2003-276931 only achieves an aligned accumulation of curled bills at a bill accumulating section, and is not configured to prevent a jamming of a curled bill at an insert port of a hopper section in a bill discriminating and counting apparatus, which is the problem to solve in the present invention.

Even if the configuration having the side hopper and the supportive side hopper is applied to an insert port of a hopper section in a bill discriminating and counting apparatus, the configuration requires a number of components, and increases the size of the apparatus, resulting in a higher manufacturing cost.

DISCLOSURE OF INVENTION

Problems to be Solved by the Invention

The present invention was made in view of the above problems, and one object of the present invention is to provide a bill discriminating and counting apparatus which is able to feed bills having different dimensions without any oblique movement, and is also able to smoothly feed bills having a curled (warped) or folded portion.

Means for Solving the Problems

The above object of the present invention is achieved by a bill discriminating and counting apparatus, comprising: a mounting platform; side hopper members symmetrically arranged on said mounting platform between which a plurality of accumulated bills having different longitudinal dimensions are filled; and a feeding mechanism for feeding said bills in serial through an insert port into a transport path, characterized in that said feeding mechanism includes a plurality of symmetrically arranged rollers which are arranged so that, when said side hopper members are separated by a distance adjusted to the largest longitudinal dimension of said bill which has the largest longitudinal dimension among said bills and also a bill which has the smallest longitudinal dimension among said bills is disposed to a position in contact with one of said side hopper members, at least a part of said roller arranged on the side opposite to that of said side hopper member in contact with said bill contacts said bill.

The above object of the present invention is also effectively achieved by the bill discriminating and counting apparatus, characterized in that said feeding mechanism comprises: a plurality of kicker rollers which are symmetrically arranged on said mounting platform for feeding said bills downstream; a plurality of feed rollers which are symmetrically arranged downstream of said kicker rollers for drawing said bills fed by said kicker rollers into said transport path; a plurality of reversing rollers disposed opposite to said feed rollers for controlling the distance between said feed rollers and said reversing rollers so that only one of said bills passes there through; a plurality of auxiliary rollers arranged opposite to said feed rollers upstream of said reversing rollers for assisting the feeding of said bills by said kicker roller; and a plurality of pinch rollers arranged opposite to said feed rollers downstream of said reversing rollers for drawing said bills, after passing through the space between said feed rollers and said reversing rollers, into said transport path, and that said kicker rollers, said feed rollers, said reversing rollers, said auxiliary rollers, and said pinch rollers are arranged so that, when said side hopper members are separated by a distance adjusted to the largest longitudinal dimension of a bill which has the largest longitudinal dimension among said bills and also a bill which has the smallest longitudinal dimension among said bills is disposed to a position in contact with one of said side hopper members, each of said rollers arranged on the side opposite to that of said side hopper member in contact with said bill at least partially contacts said bill.

The above object of the present invention is also achieved by a bill discriminating and counting apparatus, comprising: a mounting platform; side hopper members symmetrically arranged on said mounting platform between which a plurality of accumulated bills are filled; and a feeding mechanism for feeding said bills in serial through an insert port into a transport path, characterized in that said feeding mechanism includes a guide member for guiding said bills fed to said insert port toward an inlet of said transport path, and said guide member has guide surfaces formed so that the opening area thereof is gradually increased toward the both ends thereof, and said guide surfaces are formed so that the opening area thereof is converged to zero from said insert port toward the inlet of said transport path.

According to a bill discriminating and counting apparatus of the present invention which is configured as described above, since even when the bill, which has the smallest longitudinal dimension among the bills filled between the symmetrically arranged side hopper members, is disposed to a position where the bill contacts one of the side hopper members, each of the kicker rollers, the feed rollers, the reversing rollers, the auxiliary rollers, and the pinch rollers of the feeding mechanism which are arranged on the side opposite to that the side hopper member in contact with the bill (that is, the rollers on the left side when the bill is disposed to contact the right side hopper member) are arranged to at least partially contact the bill, the bills are fed in series into the transport path without any oblique movement. This increases the transmission of bills, and improves a bill counting work.

Moreover, since the guide member at the insert port has guide surfaces formed so that the opening area thereof is gradually increased toward the both ends thereof, and said guide surfaces are formed so that the opening area thereof is converged to zero from said insert port toward the inlet of said transport path, even when a bill having deformation such as curl or wrinkle at its end is fed to the insert port, the bill smoothly recovers its flat shape without butting with a front part of the guide member. This prevents an oblique movement of a bill which has decreased the transmission, and improves a counting work of bills. Furthermore, the guide member has a simple structure with fewer components, and has a shape easy to process, resulting in a lower manufacturing cost.

BEST MODE FOR CARRYING OUT THE INVENTION

Now, with reference to the drawings, embodiments of the present invention will be explained below.

First Embodiment

Figure 1:
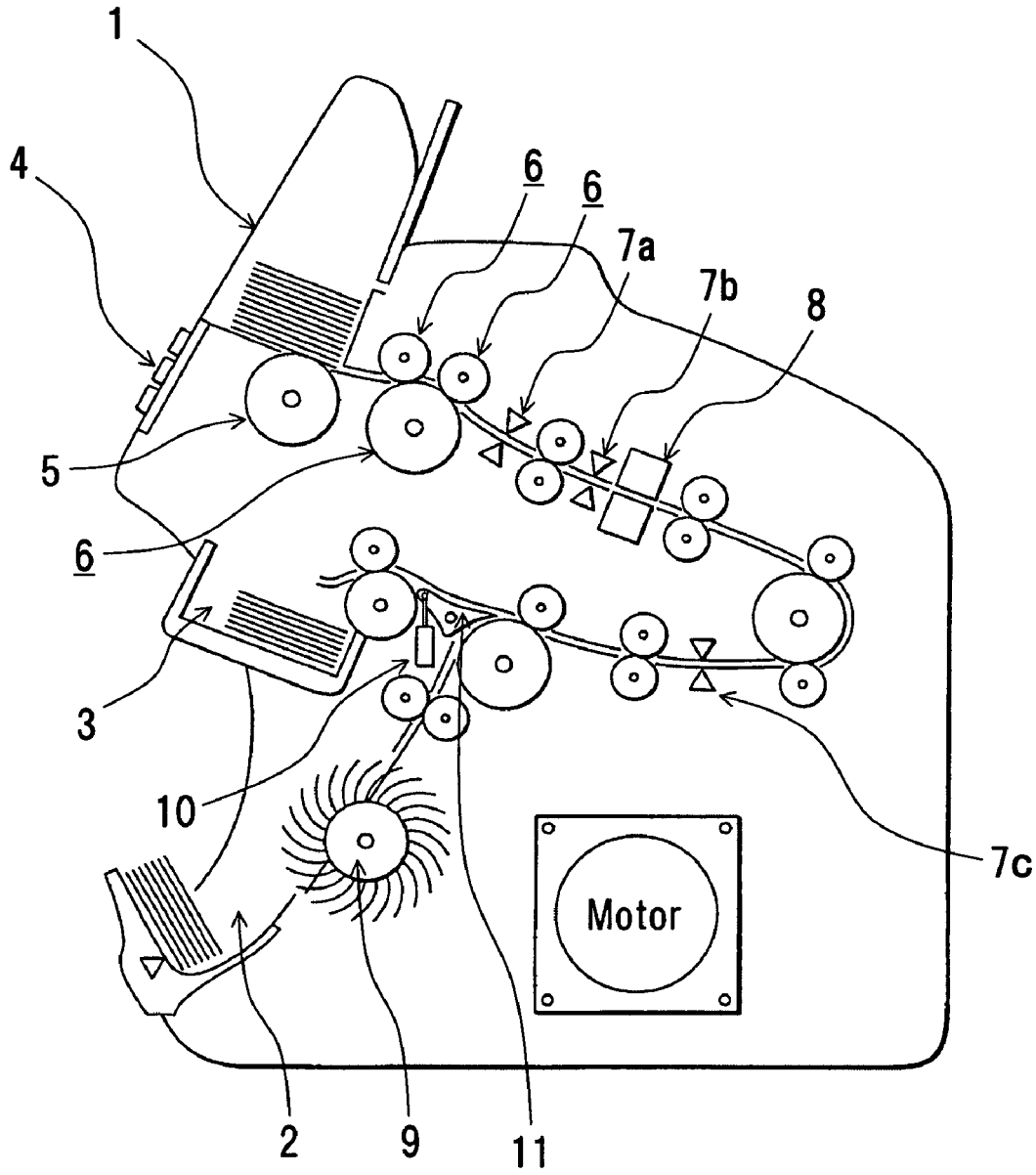
FIG. 1 is a cross-sectional view showing an internal structure of a general bill discriminating and counting apparatus.
Figure 2:
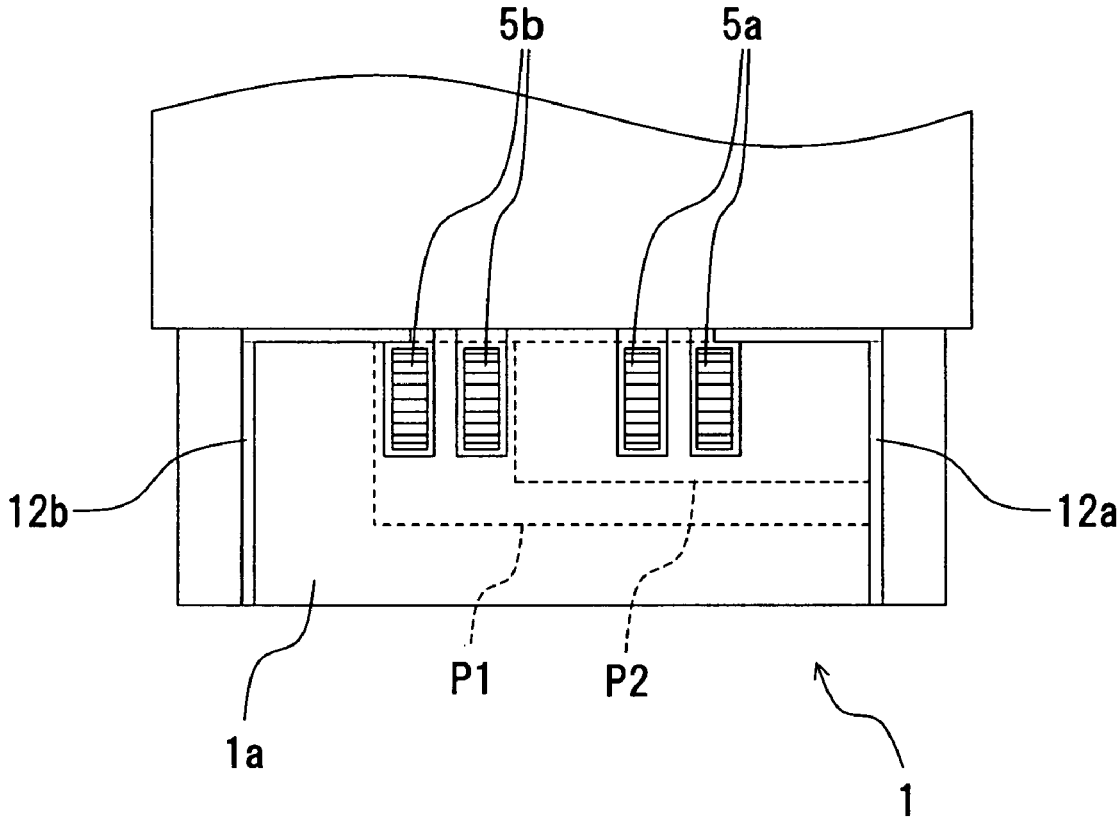
Fig.2 (PRIOR ART)
FIG. 2 is a top plan view showing a hopper section of a conventional bill discriminating and counting apparatus.
Figure 3:
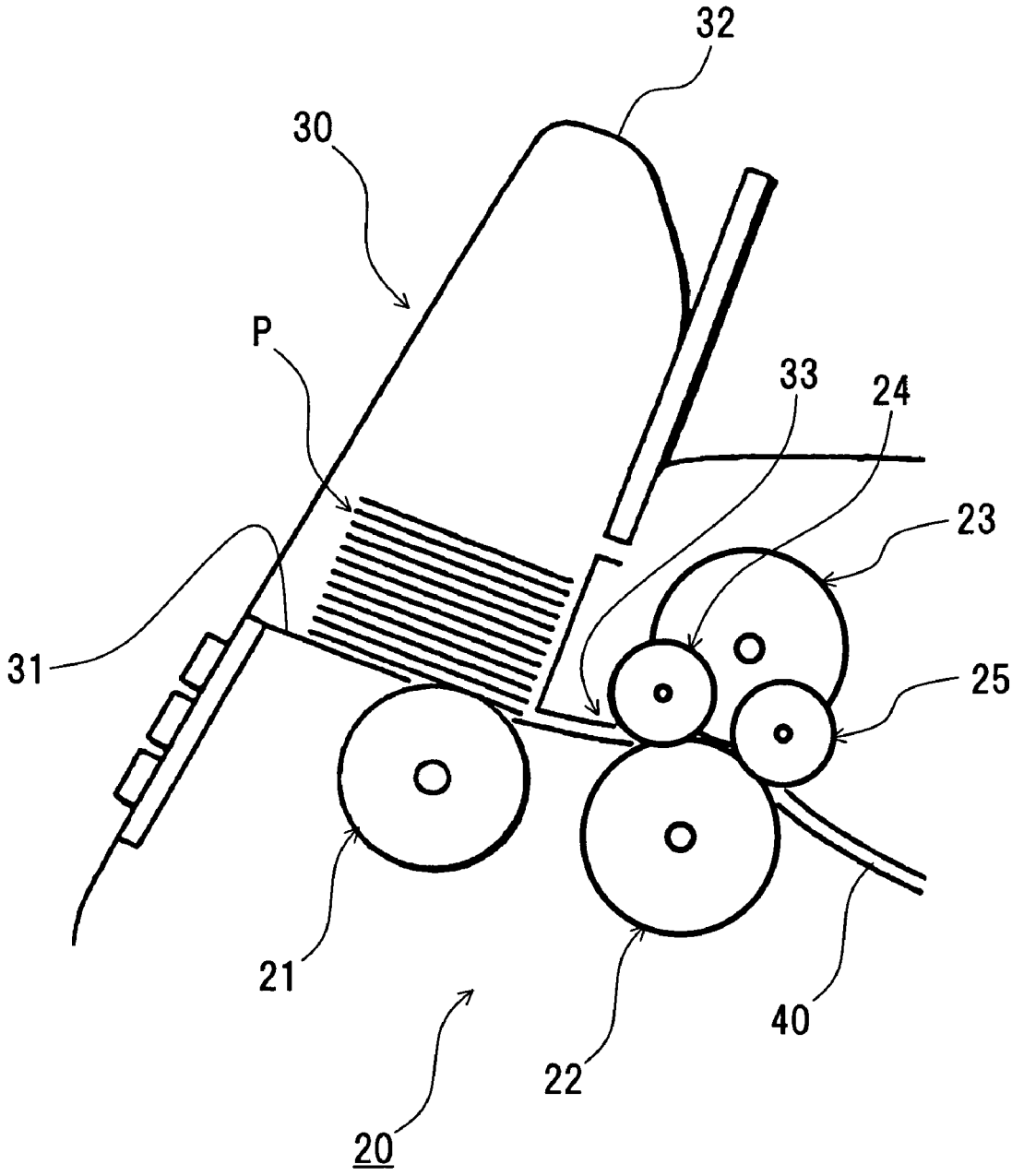
FIG. 3 is a cross-sectional view showing main sections of a feeding mechanism included in a bill discriminating and counting apparatus according to a first embodiment of the present invention.
Figure 4:
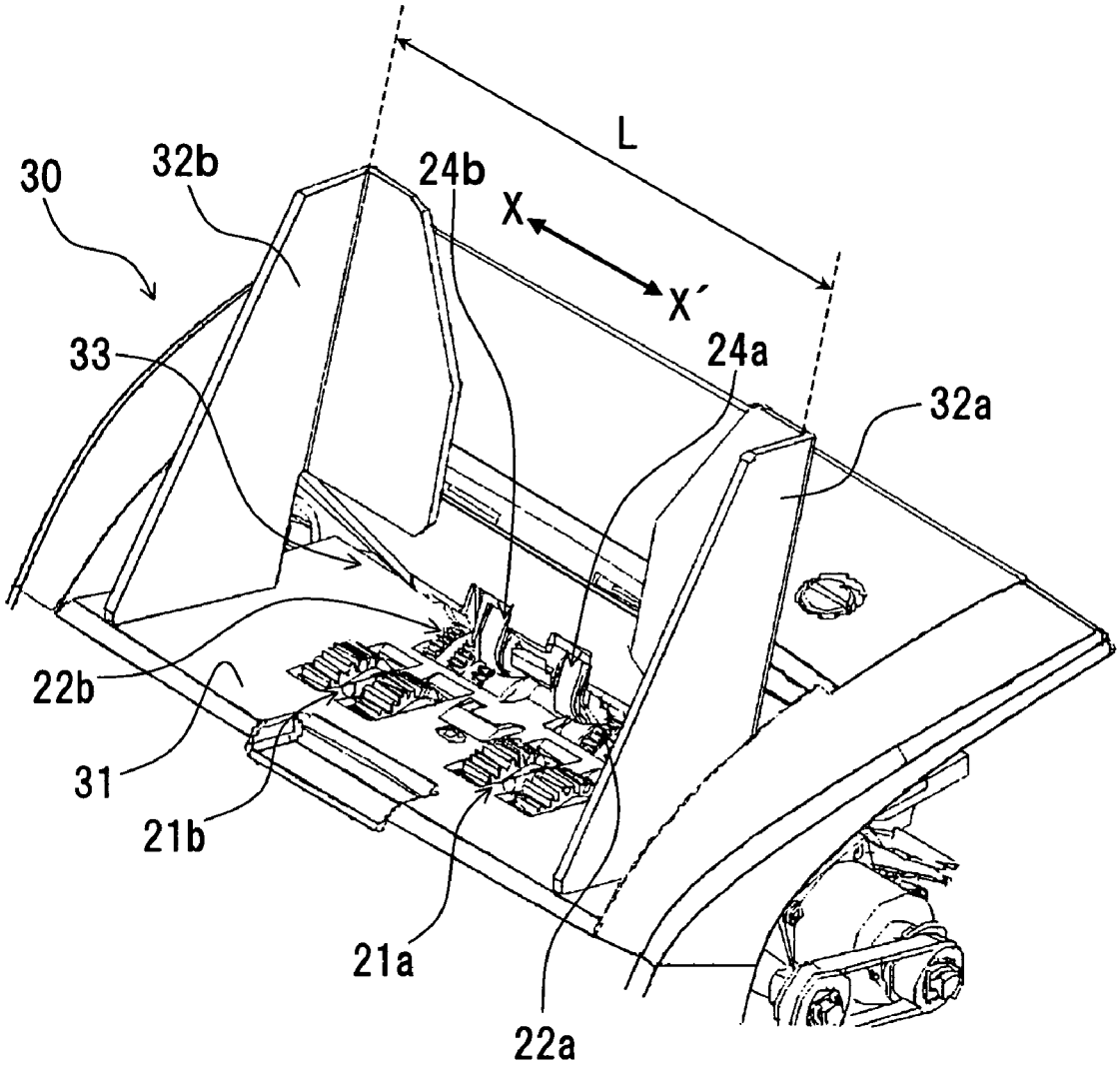
FIG. 4 is a perspective view showing an outside of the feeding mechanism.
Figure 5:
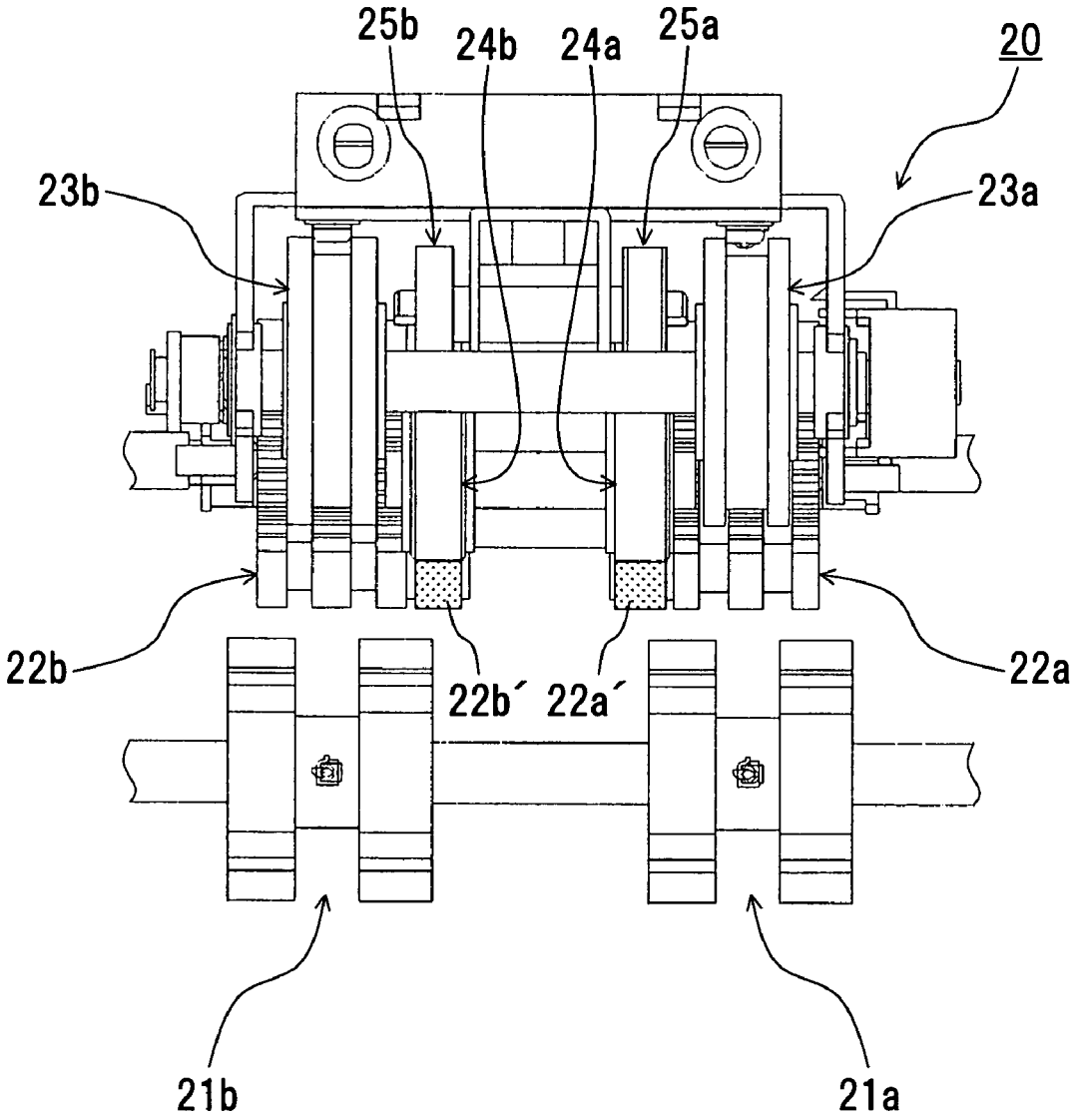
FIG. 5 is a top plan view showing an internal structure of the feeding mechanism.

FIG. 3 is a cross-sectional view showing main sections of a feeding mechanism included in a bill discriminating and counting apparatus according to a first embodiment of the present invention. FIG. 4 is a perspective view showing an outside of the feeding mechanism, and FIG. 5 is a top plan view showing an internal structure of the feeding mechanism. In these Figures, a feeding mechanism 20 of the first embodiment is configured so that a plurality of accumulated bills P having different dimensions are filled between side hopper members 32 (a right side hopper member 32*a* and a left side hopper member 32*b*) which are symmetrically arranged on a mounting platform 31 of a hopper section 30, and are fed in series through an insert port 33 into a transport path 40.

The feeding mechanism 20 includes a pair of kicker rollers 21 (a right side rollers 21*a* and a left side rollers 21*b*) which rotate clockwise in FIG. 3 for feeding the bills P in a direction toward the inside of the apparatus (in a direction to the right side in FIG. 3), and a pair of feed rollers 22 (a right side rollers 22*a* and a left side rollers 22*b*) arranged downstream of the kicker rollers 21 for drawing the bills P fed by the kicker rollers 21 into the transport path 40. The kicker rollers 21*a*, 21*b* and the feed rollers 22*a*, 22*b* are symmetrically arranged as shown in FIG. 5, respectively.

Opposing to the feed rollers 22, a pair of reversing rollers 23 (a right side roller 23*a* and a left side roller 23*b*) are symmetrically arranged to control the space between the feed rollers 22 and the reversing rollers 23 so that only one of the bills P passes there through. So, a clockwise rotation of the feed rollers 22 in FIG. 3 causes the bottom one of the bills P to pass through the feed rollers 22 and the reversing rollers 23.

Upstream of the reversing rollers 23 (on the left side in FIG. 3), a pair of auxiliary rollers 24 (a right side roller 24*a* and a left side roller 24*b*) are symmetrically arranged to oppose the feed rollers 22, and the auxiliary roller 24 are adapted to assist the feeding of the bills P by the kicker rollers 21.

Downstream of the reversing rollers 23 (on the right side in FIG. 3), a pair of pinch rollers 25 (a right side roller 25*a* and a left side roller 25*b*) are symmetrically arranged to oppose the feed rollers 22. The pinch rollers 25*a*, 25*b* are in contact with feed roller transporting sections 22*a*' and 22*b*' having a higher coefficient of friction than that of other feed roller parts 22, thereby the bills P, after passing through the space between the feed rollers 22 and the reversing rollers 23, can be drawn in the transport path 40 without fail.

As shown in FIG. 4, the side hopper members 32*a* and 32*b* symmetrically arranged on the mounting platform 31 are slidable in a direction shown by an arrow X-X' in synchronization with each other, and are configured to be able to optionally control the width L between the side hopper members 32*a* and 32*b* depending on the intended use. In the first embodiment, as shown in FIG. 6, among the bills P (for example, Euro bill) filled in the hopper section 30, the bills P1 (500 Euro: 160 mm×82 mm) having the largest longitudinal dimension has a dimension A1 (160 mm) in the longitudinal direction, and the bills P2 (5 Euro: 120 mm×62 mm) having the smallest longitudinal dimension has a dimension A2 (120 mm) in the longitudinal direction, and the width L between the side hopper members 32*a* and 32*b* are controlled to be A1+Y (160 mm+5 mm) by adding a clearance Y (5 mm) to the longitudinal dimension of the bills P1 which has the largest longitudinal dimension.

Now, with reference to FIG. 6 to FIG. 9, positional relationship between the rollers included in the feeding mechanism 20 will be explained. Herein, a case will be explained below wherein a bill P2 having the smallest longitudinal dimension (hereinafter, referred to as smallest bill) is disposed, between the right side hopper member 32*a* and the left side hopper member 32*b*, to a position closer to one of the side hopper members 32, that is, to a position where one edge (one shorter side) of the smallest bill P2 is in contact with the right side hopper member 32*a*.

Figure 6:
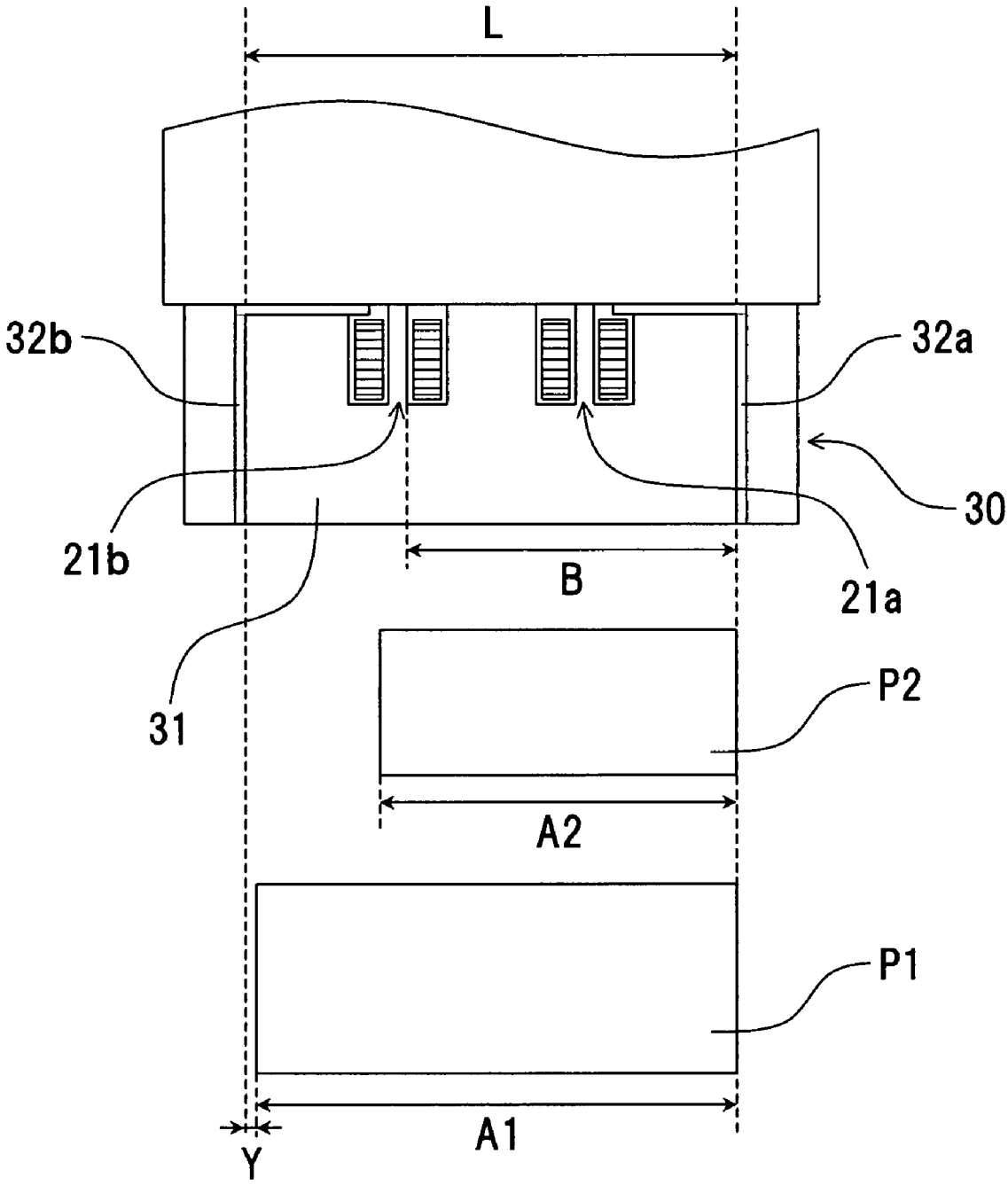
FIG. 6 is a top plan view for illustrating a positional relationship between kicker rollers of the feeding mechanism.

FIG. 6 is a top plan view for illustrating an arrangement of the kicker rollers 21*a* and 21*b*. As shown in FIG. 6, the kicker rollers 21*a* and 21*b* are arranged so that, even when the smallest bill P2 is disposed to be in contact with the right side hopper member 32*a*, at least a part of the left kicker rollers 21*b*, that is, the central (right side) roller of left kicker rollers 21*b* contacts the smallest bills P2. Therefore, the kicker rollers 21*a* and 21*b* are arranged according to the following formula:

$$B \leqq A2 \quad (1)$$

where B is a dimension from the right side hopper member 32*a* to the left edge of the rightmost roller among the left kicker rollers 21*b*.

Figure 7:
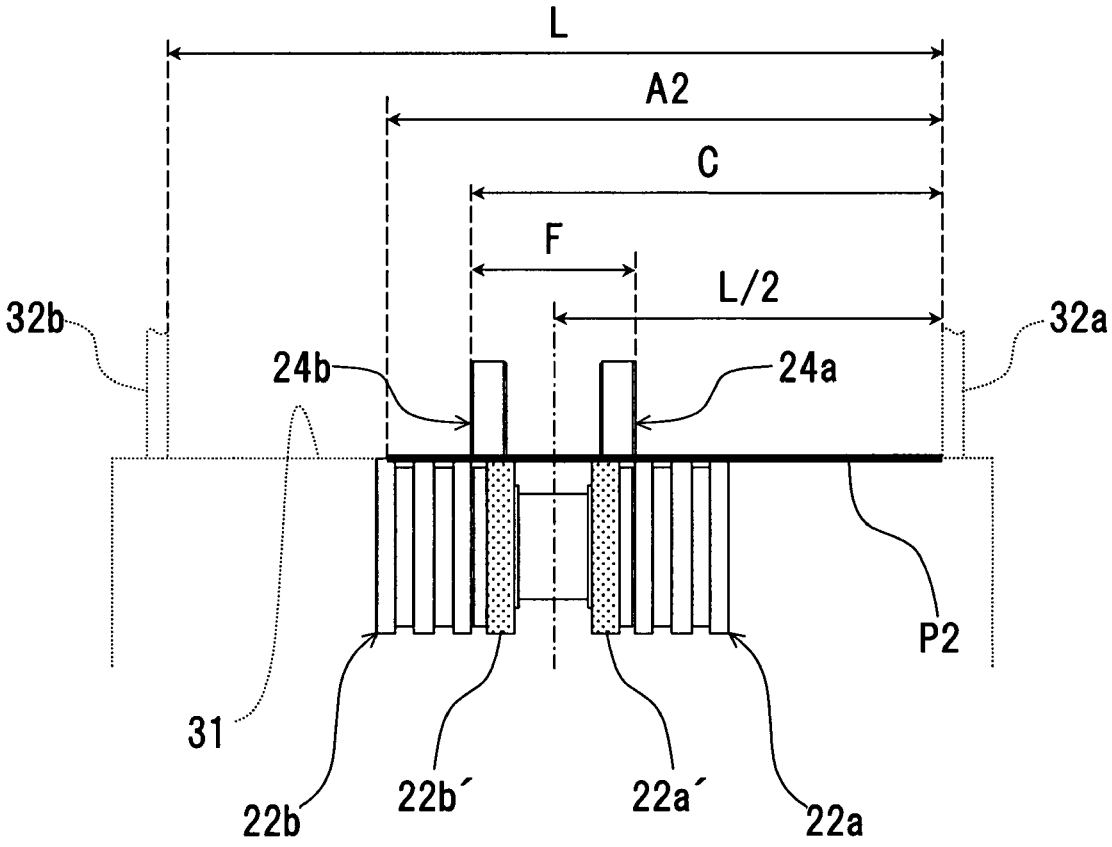
FIG. 7 is a front view for illustrating a positional relationship between a feed roller and an auxiliary roller of the feeding mechanism.

FIG. 7 is a front view for illustrating a positional relationship between the feed rollers 22*a*, 22*b* and the auxiliary roller 24*a*, 24*b*. As shown in FIG. 7, the auxiliary rollers 24*a* and 24*b* are arranged so that, even when the smallest bill P2 is disposed to be in contact with the right side hopper member 32*a*, the left auxiliary roller 24*b* contacts the smallest bills P2. Therefore, the auxiliary rollers 24*a* and 24*b* are arranged according to the following formula:

$$C \leqq A2 \quad (2)$$

where C is a dimension from the right side hopper member 32*a* to the outer end (the left end) of the left auxiliary roller 24*b*. Also, the auxiliary rollers 24*a* and 24*b* are arranged according to the following formula:

$$F/2 \leqq A2 - L/2 \quad (3)$$

where F is a dimension from the outer end (the right end) of the right auxiliary roller 24*a* to the outer end (the left end) of the left auxiliary roller 24*b*. That is, the smaller space between the right auxiliary roller 24*a* and the left auxiliary roller 24*b* allows the right auxiliary roller 24*a* and the left auxiliary roller 24*b* to be arranged according to the formula (3), and to contact the smallest bills P2 wherever the smallest bill P2 is disposed between the side hopper members 32.

Figure 8:
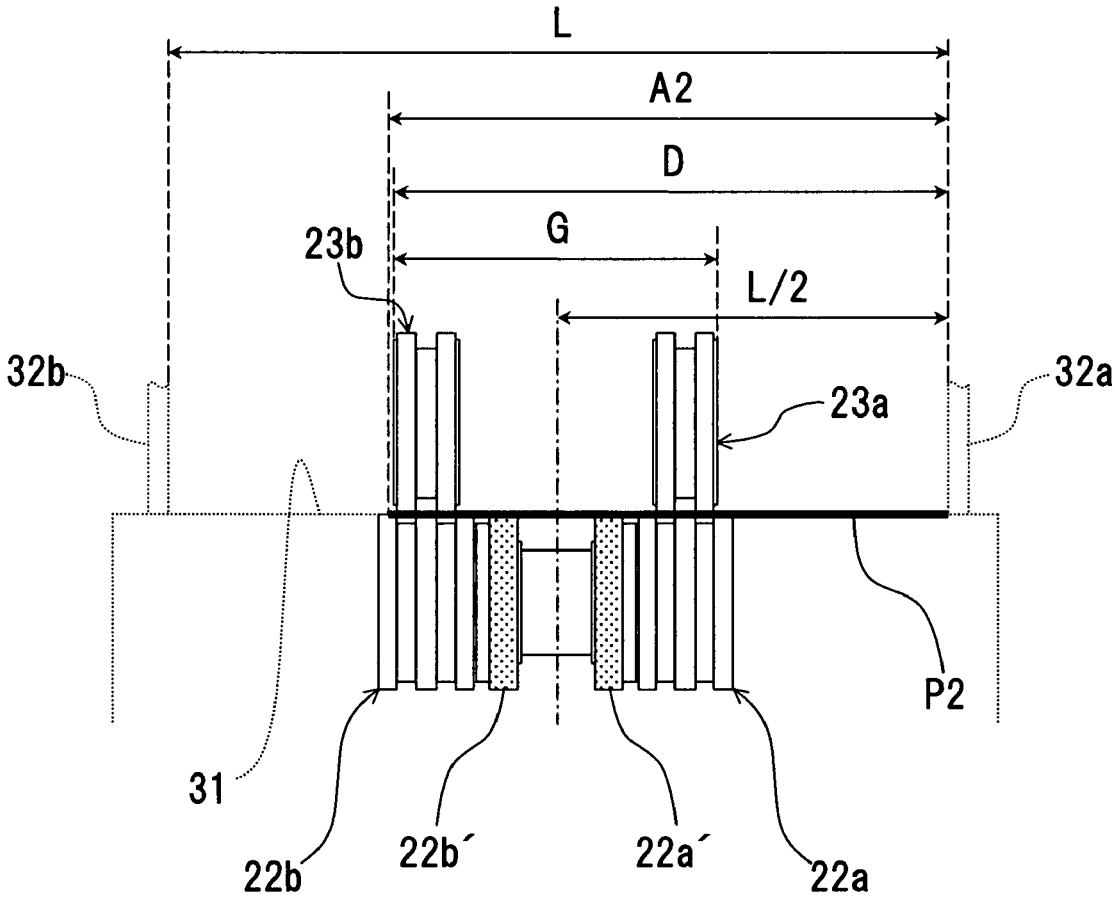
FIG. 8 is a front view for illustrating a positional relationship between a feed roller and a reversing roller of the feeding mechanism.

FIG. 8 is a front view for illustrating a positional relationship between the feed rollers 22*a*, 22*b* and the reversing rollers 23*a*, 23*b*. As shown in FIG. 8, the reversing rollers 23*a*, 23*b* are arranged so that, even when the smallest bill P2 is disposed to be in contact with the right side hopper member 32*a*, the left reversing rollers 23*b* contacts the smallest bills P2. Therefore, the reversing rollers 23*a*, 23*b* are arranged according to the following formula:

$$D \leqq A2 \quad (4)$$

where D is a dimension from the right side hopper member 32*a* to the outer end (the left end) of the left reversing rollers 23*b*. Also, the reversing rollers 23*a*, 23*b* are arranged according to the following formula:

$$G/2 \leqq A2 - L/2 \quad (5)$$

where G is a dimension from the outer end (the right end) of the right reversing rollers 23*a* to the outer end (the left end) of the left reversing rollers 23*b*. That is, the smaller space between the right reversing roller 23*a* and the left reversing roller 23*b* allows the right reversing roller 23*a* and the left reversing roller 23*b* to be arranged according to the formula (5), and to contact the smallest bills P2 wherever the smallest bill P2 is disposed between the side hopper members 32.

Figure 9:
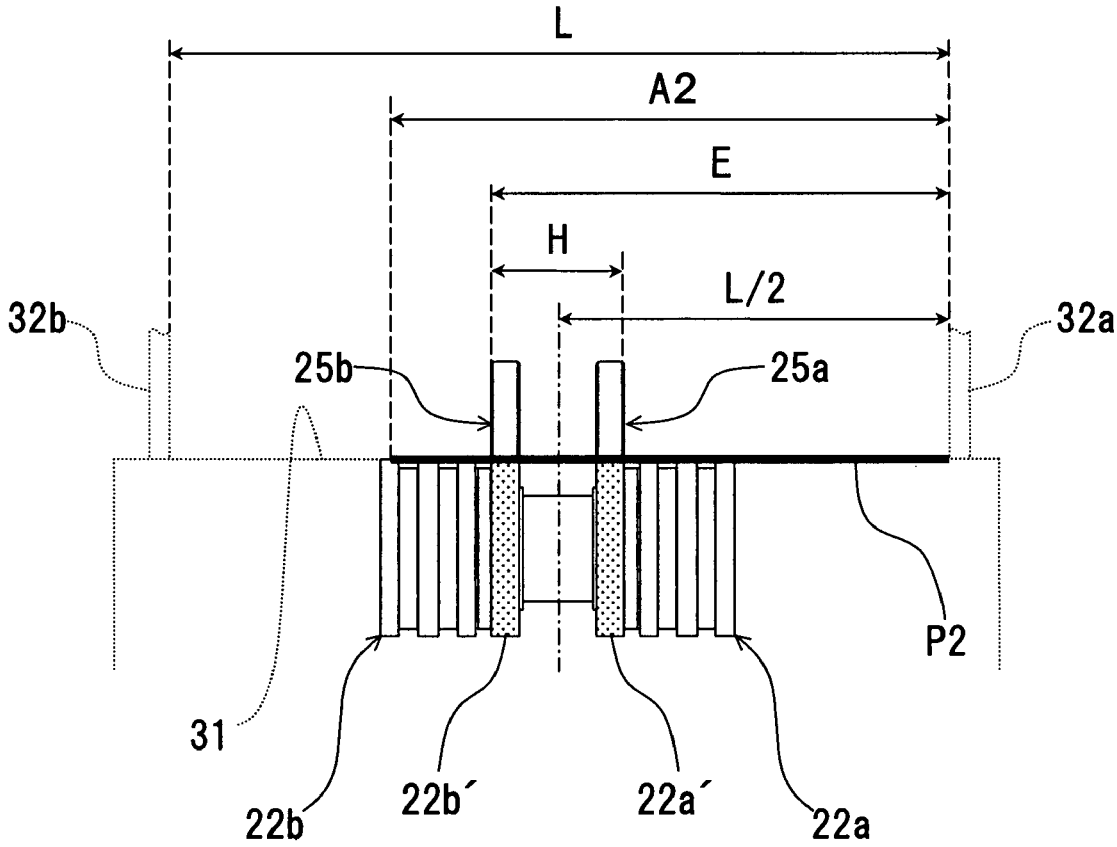
FIG. 9 is a front view for illustrating a positional relationship between a feed roller and a pinch roller of the feeding mechanism.

FIG. 9 is a front view for illustrating a positional relationship between the feed rollers 22*a*, 22*b* and the pinch rollers 25*a*, 25*b*. As shown in FIG. 9, the pinch rollers 25*a*, 25*b* are arranged so that, even when the smallest bill P2 is disposed to be in contact with the right side hopper member 32*a*, the left pinch roller 25*b* contacts the smallest bills P2. Therefore, the pinch rollers 25*a*, 25*b* are arranged according to the following formula:

$$E \leqq A2 \quad (6)$$

where E is a dimension from the right side hopper member 32*a* to the outer end (the left end) of the left pinch roller 25*b*. Also, the pinch rollers 25*a*, 25*b* are arranged according to the following formula:

$$H/2 \leqq A2 - L/2 \quad (7)$$

where H is a dimension from the outer end (the right end) of the right pinch roller 25*a* to the outer end (the left end) of the left pinch roller 25*b*. That is, the smaller space between the right pinch roller 25*a* and the left pinch roller 25*b* allows the right pinch roller 25*a* and the left pinch roller 25*b* to be arranged according to the formula (7), and to contact the smallest bills P2 wherever the smallest bill P2 is disposed between the side hopper members 32.

In FIG. 6 to FIG. 9, while the case wherein the smallest bill P2 contacts the right side hopper member 32*a* has been explained, since the pairs of rollers included in the feeding mechanism 20 are symmetrically arranged respectively, the similar result is true for the case wherein the smallest bill P2 contacts the left side hopper member 32*b*.

In FIG. 7 to FIG. 9, the auxiliary rollers 24, the reversing rollers 23, and the pinch rollers 25 are symmetrically arranged as pairs, but the present invention is not limited to the arrangement, and each type of the rollers may include a plurality of rollers to arrange on one side. In the latter case, the centermost roller among the symmetrically arranged rollers is arranged to contact the smallest bill P2.

As described above, according to the first embodiment of the bill discriminating and counting apparatus of the present invention, the kicker rollers 21, the feed rollers 22, the reversing rollers 23, the auxiliary rollers 24, and the pinch rollers 25 included in the bill feeding mechanism 20 are arranged so that, when the symmetrically arranged side hopper members 32*a*, 32*b* are separated by a distance adjusted to the longitudinal dimension A1 of the bills P1 and also the bill P2 having the smallest longitudinal dimension among the bills P is disposed to be in contact with one of the side hopper members 32, each of the right side rollers 21*a*, 22*a*, 23*a*, 24*a*, and 25*a*, and the left side rollers 21*b*, 22*b*, 23*b*, 24*b*, and 25*b* at least partially contact the bill P2. That is, the plurality of roller included in the bill feeding mechanism 20 are arranged so that at least a part of the rollers arranged on the opposite side to that of the side hopper member 32 in contact with the bills P2 contacts the bills P2. This configuration allows the bills P filled in the hopper section 30 which have a large difference in the longitudinal dimensions like Euro bill to be fed in serial into the transport path 40 without any oblique movement. As a result, the transmission of bills is increased, and a counting work of bills is improved.

Second Embodiment

Next, with reference to FIG. 10 and FIG. 11, a second embodiment of the present invention will be explained below. In the embodiment, the same members are designated by the same reference numbers as those in the first embodiment, and will not be explained.

Figure 10:
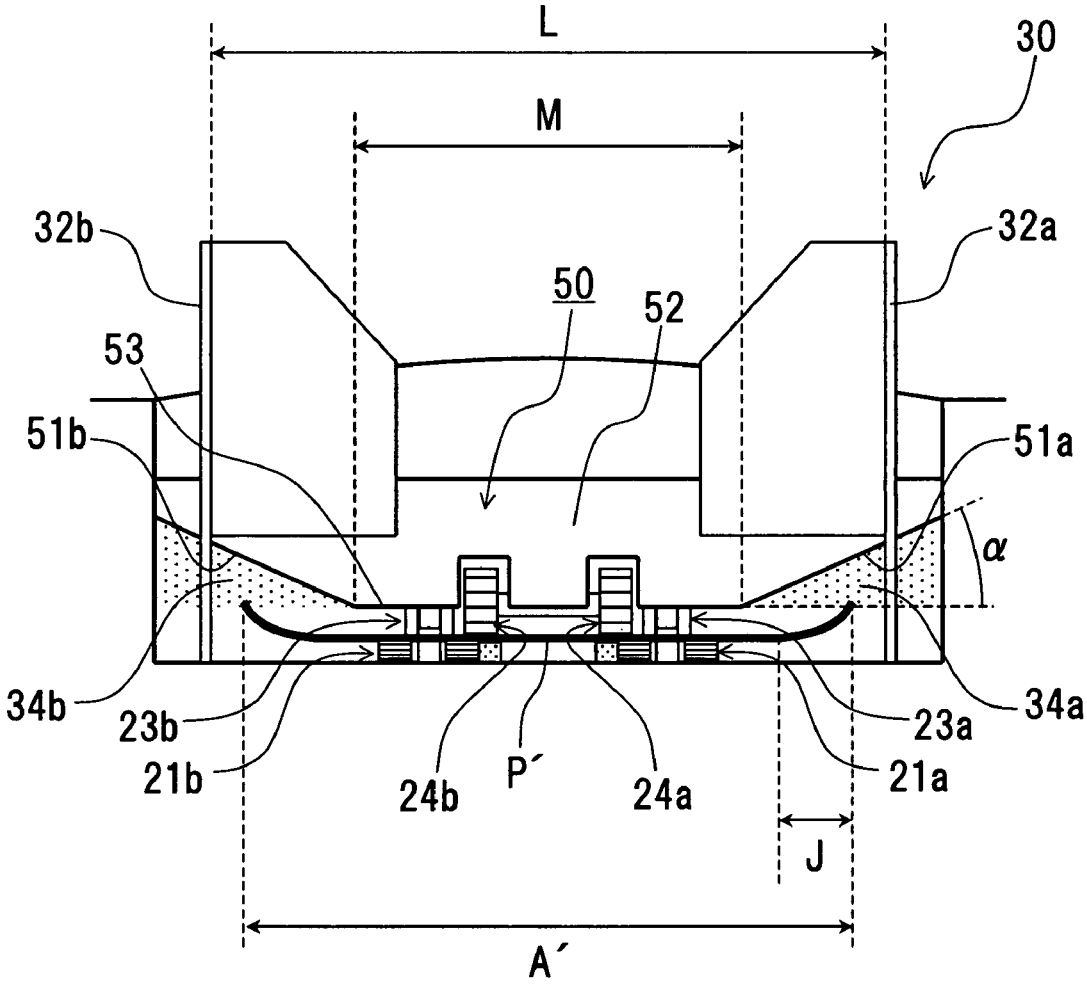
FIG. 10 is a front view showing an outside of a hopper section included in an bill discriminating and counting apparatus according to a second embodiment of the present invention.
Figure 11:
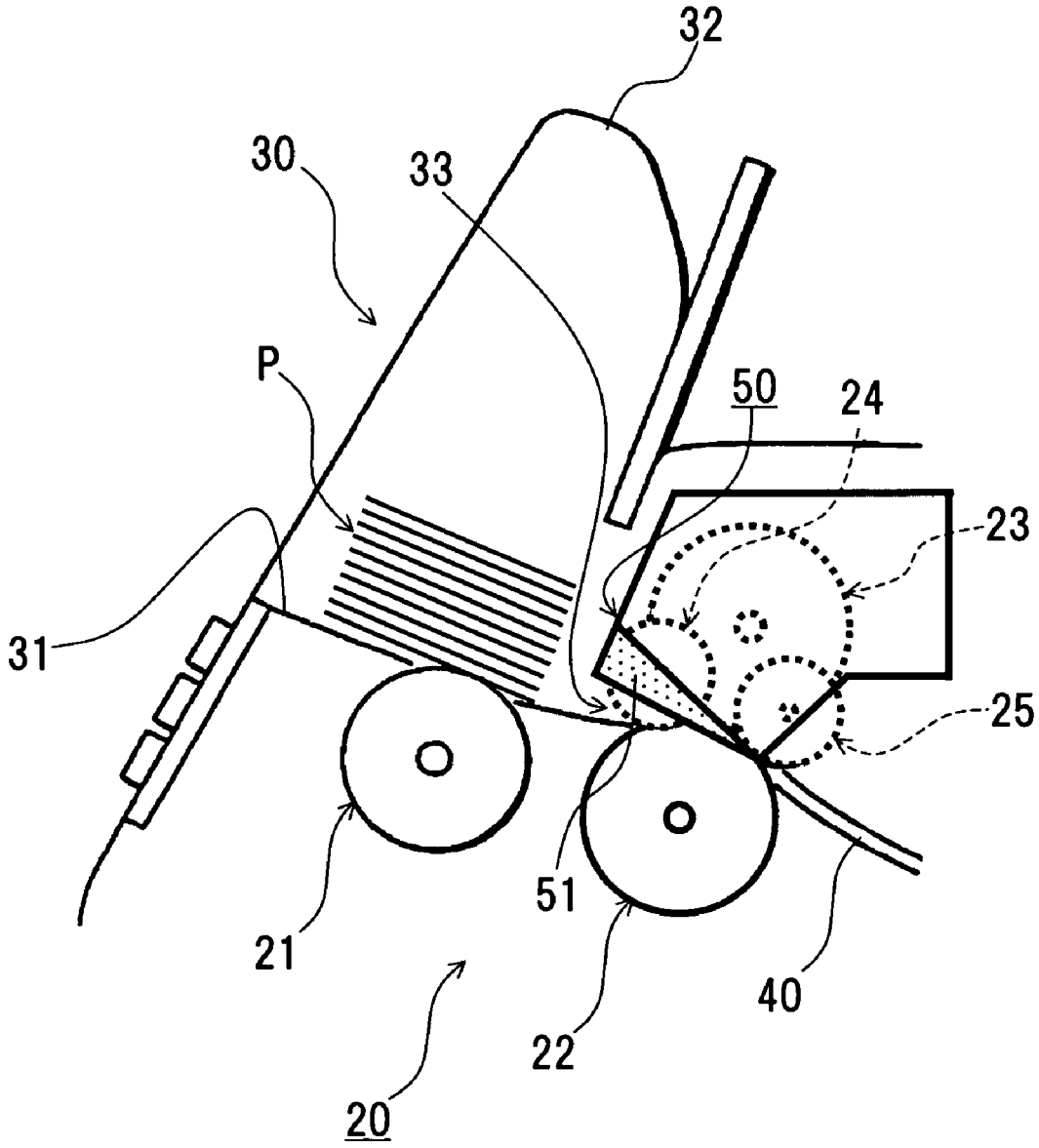
FIG. 11 is a side view showing main sections of the internal structure of a hopper section and feeding mechanism included in the bill discriminating and counting apparatus.

FIG. 10 is a front view showing a hopper section included in a bill discriminating and counting apparatus according to a second embodiment of the present invention, and FIG. 11 is a side view showing main sections of the internal structure thereof. As shown in FIG. 11, the hopper section 30 has the mounting platform 31 on which a plurality of the accumulated bills P are filled between the side hopper members 32 (the right side hopper member 32*a* and the left side hopper member 32*b*). The mounting platform 31 is provided with the kicker rollers 21 for feeding the bills P in a direction toward the insert port 33. Below the insert port 33 is provided with the feed rollers 22, and above of the insert port 33 is provided with the reversing rollers 23, the auxiliary rollers 24, and the pinch rollers 25 at positions opposing to the feed rollers 22. The feeding mechanism 20 including these rollers causes the bills P filled in the hopper section 30 to be fed one by one through the insert port 33 into the transport path 40.

Also, above the insert port 33 is provided with a guide member 50 for guiding the fed bills P to the pinch rollers 25 which form an inlet of the transport path. The guide member 50 has, as shown in FIG. 10, guide surfaces 51*a*, 51*b* formed so that the opening areas 34*a*, 34*b* thereof is gradually increased toward the both ends thereof. Due to this configuration, when a bill P' among the bills P filled in the hopper section 30 which has deformation at its ends such as curl or wrinkle is fed to the insert port 33, the bill P' is prevented from butting with a front surface 52 of the guide member 50.

The guide surfaces 51 are formed, as shown in FIG. 11, across from the insert port 33 to the pinch rollers 25. Also, the guide surfaces 51*a*, 51*b* are formed so that the opening area thereof is converged to zero toward the pinch rollers 25 which form the inlet of said transport path. This configuration allows the bills P' having the above described deformation, after passing the insert port 33, to recover its original flat shape before it reaches the pinch rollers 25, and to be smoothly fed into the transport path 40.

In the embodiment, as shown in FIG. 10, the guide member 50 has the guide surfaces 51 which form an angle $\alpha$ of 30 degrees with the bottom surface 53 thereof, but the present invention is not limited to the configuration, and the guide member 50 may have any guide surfaces 51 which allow the bills P' having deformation to smoothly recover its original flat shape without butting with the front part 52 of the guide member 50.

Also, the guide member 50 includes the bottom surface 53 having a width M at the insert port 33 which can be expressed by the following formula:

$$2(A'-L/2-J)\geqq M \tag{8}$$

where A' is the longitudinal dimension of the fed bill P', and J is the width of deformation formed on the bills P'.

As described above, according to the second embodiment of the bill discriminating and counting apparatus of the present invention, the guide member 50 above the insert port 33 has guide surfaces 51*a*, 51*b* which are formed in a shape flared toward the both edges thereof to have larger opening areas 34*a*, 34*b*, and the guide surface 51*a*, 51*b* are also formed in a shape tapered from the insert port 33 toward the inlet of the transport path 40 to have opening areas 34*a*, 34*b* of zero. Due to this configuration, when a bill which has deformation at its end such as curl or wrinkle is fed to the insert port 33, the bill can smoothly recover its original flat shape without butting with a front surface 52 of the guide member 50. As a result, troubles such as oblique movements which decrease the transmission of bills can be prevented, which leads an improvement of a bill counting work.

While the present invention has been specifically explained, the present invention is not limited to the above explanation, and various modification can be made without departing from the scope of the present invention.

INDUSTRIAL APPLICABILITY

The present invention can be applied to a bill discriminating and counting apparatus in which bills are accepted in a hopper for discriminating denominations of the accepted bills and counting the bills so that the total amount of the received bills or the number of the received bills for each denomination is calculated, and the present invention is particularly useful to a case where bills having different dimensions or bills having deformation such as curl (warp) or folding should be smoothly fed into an apparatus.

The invention claimed is:

1. A bill discriminating and counting apparatus, comprising:

a mounting platform;

side hopper members symmetrically arranged on said mounting platform between which a plurality of accumulated bills are filled; and a feeding mechanism for feeding said bills in serial through an insert port into a transport path, characterized in that said feeding mechanism includes a guide member for guiding said bills fed to said insert port toward an inlet of said transport path, and said guide member has guide surfaces formed so that the opening area thereof is gradually increased toward the both ends thereof, and said guide surfaces are formed so that the opening area thereof is converged to zero from said insert port toward the inlet of said transport path.

* * * * *